United States Patent [19]

van Allen

[11] Patent Number: 4,458,871

[45] Date of Patent: Jul. 10, 1984

[54] SOAP SPINDLE

[76] Inventor: John W. van Allen, 202 Merced Ave., Santa Cruz, Calif. 95060

[21] Appl. No.: 404,622

[22] Filed: Aug. 2, 1982

[51] Int. Cl.[3] ..... A47F 5/00

[52] U.S. Cl. ..... 248/309.2; 211/87; 211/88; 248/359

[58] Field of Search ..... 248/309 A, 360, 359; 211/59.1, 60 R; D6/89, 90; 211/32, 61, 44

[56] References Cited

U.S. PATENT DOCUMENTS

| | | | |
|---|---|---|---|
| D. 199,321 | 10/1964 | Peterson | 211/60 R |
| 436,600 | 9/1890 | Hartman | 211/87 X |
| 2,157,001 | 5/1939 | Morley | 211/87 X |
| 3,315,933 | 4/1967 | Tatham | 248/309 A |
| 3,325,133 | 6/1967 | Bertges | 248/309.2 X |
| 3,693,923 | 9/1972 | Ayoub et al. | 211/88 X |
| 4,278,225 | 7/1981 | Phelps | 211/88 X |

FOREIGN PATENT DOCUMENTS

| | | | |
|---|---|---|---|
| 160326 | 1/1904 | Fed. Rep. of Germany | 248/309.2 |
| 484225 | 9/1917 | France | 248/359 |
| 106085 | 6/1917 | United Kingdom | 248/359 |

*Primary Examiner*—Ramon S. Britts
*Assistant Examiner*—Sarah A. Lechok

[57] ABSTRACT

A soap holder is provided having a flat back member adapted for wall mounting with an arcuate, convex arm extending outwardly and down from the back member and having a spindle extending upwardly from near the terminal end for the retention of a cake of soap.

3 Claims, 2 Drawing Figures

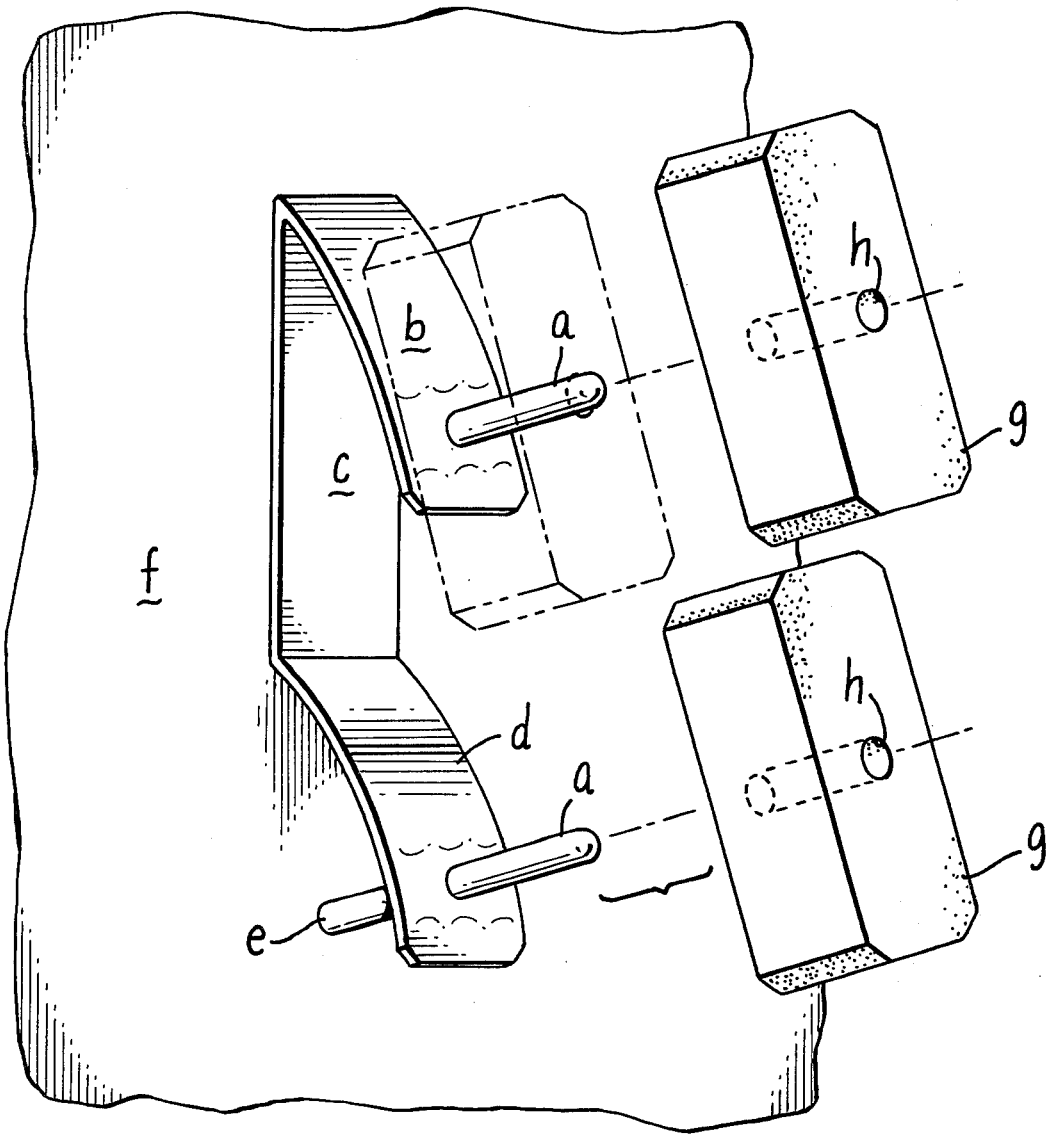
b
a
h
g
c
f
d
a
h
g
e

SOAP SPINDLE

SUMMARY OF THE INVENTION

This invention, novel in the realm of Soap Retaining Devices, embodies a brace of elements heretofore foreign to each other, in order to produce an uniquely functional, beneficial and generally efficient result not previously experienced in the bath, shower, lavatory or wheresoever one might elect to retain bar soap in a location convenient for use, and without the untidy mess so often associated with the traditional soap dish. This combination of elements consists of a basic fixture, which shall be referred to as a Soap Spindle for obvious reasons, and an especially designed bar of soap, compatible with the aforementioned Soap Spindle. In most soap receptacles, the receptacle conforms to the bar of soap; in the case of the Soap Spindle, it becomes the reverse, as the soap has adapted to the means for retaining it. The variety of soap shapes and sizes is infinite; the one thing they possess in common, is a center of gravity. For practical purposes, the only part of the soap which is not used, is its center; that amount of the bargain is ritually relegated to the waste basket. Therefore, by initially omitting a calculated volume of the soap mass in the course of manufacture, the rewards are two-fold, i.e.: Soap has been spared, and a means by which the soap bar can be held in a convenient position in or about the area where it is frequently used has been established. The soap mass omitted from the center of one bar, will become an integral part of a subsequent bar of soap.

Although designed to be affixed to a vertical surface, the Soap Spindle can be adapted to horizontal surfaces, or other special conditions by re-arrangement of one or more of its components, achieving the same useful end.

BRIEF DESCRIPTION OF THE DRAWINGS

FIG. 1 is a perspective view of a soap holder embodying the present invention.

FIG. 2 is a perspective view of two cakes of soap modified for use with the present invention.

DESCRIPTION OF THE PREFERRED EMBODIMENTS

The Soap Spindle, FIG. 1, consists of a base of convenient format (c), and a coextensive leaf (b), folded back upon the base in such a manner as to provide a spindle (a) emanating from it, with a slight acclivity when the Soap Spindle is mounted upon a preferably vertical surface such as a wall, shower door or splashboard. Material used in the construction of the Soap Spindle should be of a flexible nature, and the finished unit must have no sharp edges or points. The leaf (b) is preferred left flexible to aid in preventing damage or injury in the event of impact with the unit accidentally when the Soap Spindle is secured in position for use. Leaves may be plane or curved surfaces.

The Soap Spindle, by effecting a coextension of base (c) at its lower extremity, sensibly parallel to leaf (b), manifests a second leaf (d), which when given a sindle as in (a), becomes capable of handling a second bar of soap of the type described in the following:

Spindle Soap, FIG. 2, may be a bar of any convenient format, although extreme aspect ratios are not desirable, and oval shapes or round shapes are preferred over others; this latter preference is one of an academic nature, and does not necessarily apply in practice. The soap mass requires a cylindrical cavity through its least dimension, the center of which is the lesser axis of the gravitational center of that mass, and whose diameter is slightly greater than that of the spindle, FIG. 1, (a).

Water, bearing soap waste, is an unavoidable consequence of use and will drip freely from the spindled soap, promoting drying; residual moisture will be free to evaporate, as the soap has minimal contact with the unit, greatly minimizing waste resulting from "mushy" soap. In instances where the Soap Spindle is not in a position to drip into a tub, shower pan or basin, a small saucer may be placed beneath the soap in a strategic position, if desired.

As an optional convenience, spindles (a) may be extended through the leaf (b), or (d), and with the respective rounded tips of these extensions tangent to the surface below them and lightly in contact with that surface, provide a means for holding a wash cloth between the spindle extension and the proximate surface, necessary pressure being supplied by the spring effect of the leaf (b). Cloth can be pulled free without damage. Spindle extension shown as (e), FIG. 1.

I claim:

1. A soap holder for the retention of a cake of soap, said soap having a hole completely through said cake comprising in combination:
   a. a flat member adapted to be held against a vertical wall or the like, said flat member having a top and a bottom,
   b. an arcuate member attached to the top of said flat member and curving outwardly and downwardly therefrom to provide an outer convex surface having a terminal end and
   c. a round spindle extending outwardly from near the terminal end of said arcuate member, said spindle extending at substantially a right angle to said arcuate member and inclined upwardly, said spindle being the sole projection from said surface, whereby a cake of soap having a hole can be placed on said spindle and retained thereby with minimal contact between the soap and said arcuate member.

2. The soap holder of claim 1 having a second arcuate member extending outwardly from the bottom of said flat member, said second arcuate member having substantially the same structure as said arcuate member of paragraph b whereby two cakes of soap can be independently held on said soap holder.

3. The soap holder of claim 1 wherein said spindle also extends inwardly from said arcuate member into light contact with a mating flat surface whereby a cloth or the like may be releasably engaged between the surface and the inner extension of said spindle.

* * * * *